United States Patent [19]

Murphy

[11] 3,957,250

[45] May 18, 1976

[54] PLASTIC FENCE POST

[76] Inventor: Stanley E. Murphy, 16355 E. Brown Drive, Aurora, Colo. 80013

[22] Filed: Apr. 14, 1975

[21] Appl. No.: 567,557

[52] U.S. Cl. ..... 256/19; 256/51

[51] Int. Cl.[2] ..... E04H 17/14

[58] Field of Search ..... 256/19, 24, 35, 51; 52/155, 158, 157

[56] References Cited

UNITED STATES PATENTS

| | | | |
|---|---|---|---|
| 2,618,037 | 11/1952 | Miller | 256/19 |
| 3,720,401 | 3/1973 | Loch | 256/19 |
| 3,740,024 | 6/1973 | Hellerich et al. | 256/19 |
| 3,875,699 | 4/1975 | Lamarre | 256/19 |

*Primary Examiner*—Paul R. Gilliam
*Assistant Examiner*—Doris L. Troutman

[57] ABSTRACT

An improved fence post fabricated from suitable plastic material and arranged in a tubular configuration having a plurality of pins outwardly extending at right angles to each other from the lower portion of the post and a plurality of holes spaced vertically from each other to receive clips, bolts or other devices for securing strands of wire in the upper portions. The post is fabricated from a plastic material having suitable strength dielectric and fire retardant characteristics. The side wall of the post can be formed with longitudinal strengthening ribs or flanges and/or the interior filled with at least a semi-rigid or rigid foam to impart additional strength.

3 Claims, 8 Drawing Figures

PLASTIC FENCE POST

BACKGROUND OF THE INVENTION

This invention is directed to an improved plastic fence post having a plurality of wire attaching and reinforcing devices.

Fence posts are a common item which have been known and used for many years in order to retain objects such as animals within a confined area or on the other hand, to prevent objects from entering a restricted area. Most fence posts are merely poles or elongated members made of wood, concrete or possibly metal such as steel. In the case of a wood post, the fence wire is merely stapled to the side of the post to secure the strands in spaced relation above the ground. Where metal posts are used, usually the base has an outwardly extending vertical flange which prevents the post from being rotated. The wire is held to the upper part of the post by means of clips which are wrapped around the wire and post to secure them in place.

The prior art in this field is generally quite old. U.S. Pat. No. 317,558 issued in 1885 shows a metal fence post having outwardly extending base flanges to prevent the rotation of the post after being buried in the ground and provides a plurality of holes drilled through the post for securing strands of fence wire. The base flanges are provided as anchor plates inserted through slots in the base of the post. With this fence post, a wire staple is passed through the upper holes to secure the fence while a bolt can be passed through the holes if it is desired to secure wooden cross members for the purpose of providing a picket or board fence. Another patent, U.S. Pat. No. 982,957, issued to Haddon in 1911, discloses a hollow fence post formed from concrete and a plurality of vertically spaced holes passing therethrough for the purpose of anchoring the fence wire with clips. A wedge shaped implement is provided on the back side of the post for securing the clip and tightening it in position. There were no anchors provided on this post for securing the post in the ground.

Some of the major problems encountered in fence posts today are their weight and the cost of shipping and storage. The use of metal which is subject to weathering and soil deterioration greatly increases the weight and thus the cost of shipping and handling this type of post. A concrete post while having fair weathering characteristics is extremely heavy and expensive to ship, not to mention being fragile. While wood is relatively light weight when compared to the other materials, it is becoming rather expensive and generally bulky or thick to obtain reasonable strength. Because of this, shipping expenses again are high due to space requirements.

SUMMARY OF THE INVENTION

It is an object of the present invention to provide a light weight, slender fence post having sufficient strength for the intended use but yet inexpensive to ship and store.

Another object of the present invention is to provide a fence post which is made from man-made inexpensive materials which is both easy and economical to manufacture.

A further object of the present invention is to provide a fence post which will not conduct electricity for use with electrically charged fences.

A still further object of the present invention is to obtain a fence post which is unaffected by weather including temperature and moisture and which is chemically inert to withstand chemical attack or soil conditions.

The present invention is directed to an improved fence post which provides a new result by utilizing plastic or synthetic resin materials throughout. A hollow, tubular, exterior post member having an open center is provided in one form. In the base portion of the post, which is that portion to be buried in the ground, one or more pairs of aligned holes may be provided across the post with the holes usually positioned at right angles to each other. A plastic rod or tube, or other type of material, is arranged to pass through these holes and extend outwardly beyond each side of the post. These tubes or rods can be cemented in place or allowed to remain free since once the post is buried there can be no movement.

The upper part of the post is provided with a plurality of vertically spaced pairs of aligned holes passing through the post. These holes can be spaced in any pattern desired to accommodate the total number of fence wires desired and usually are vertically aligned. In one form, a short plastic insert tube is provided in each hole and sealed at the ends to the sidewall of the post.

The fence wires can be secured to the post by means of an elongated, wire clip passing through the desired holes and tube. This clip can be easily removed by squeezing the ends together. In another arrangement an open eye-bolt can pass through the holes and tube and be threadedly secured to the post with the fence wire passing through the eye. As a further alternative, the fence wire can pass directly through the hole in the post and thus be supported by the post.

The post as stated above is fabricated from plastic such as ABS or fiber reinforced synthetic resins which are weather resistant and not subject to deterioration by acid or alkaline soil conditions. The insert tube and anchor rods may be of various sizes and provided with various wall thicknesses to provide the desired strength for the purpose intended. The entire post may, also, be reinforced by filling the inside with any type of normally available filler material to form a rigid or semi-rigid core throughout the interior. This core may be foamed plastic such as foamed urethane, styrofoam or the like; or can include other materials such as shredded paper, straw, or other filler materials packed and held together with an adhesive or other material which provides an essentially rigid core. It is also possible to provide a granular or particulate material such as gravel or scrap materials held together with an adhesive or possibly cement. Longitudinal flanges or grooves can be molded or formed in the interior or sidewall of the post to add additional strength. A reinforcing sleeve can be provided around the outside or inside surface of the post at ground level to further reinforce it.

The use of plastics has several decided advantages such as providing a dielectric characteristic which permits the post to be used to support an electric fence without the necessity for the conventional insulators. In addition, the weathering capability of plastic or synthetic resin material is decidedly better than other conventional materials since they are practically impervious to moisture, temperature and other weathering effects. To prevent moisture from entering the inner portion of the post, a cap or cover is provided on the uper end and is attached by means of adhesive in order to seal the joint to prevent the introduction of moisture.

BRIEF DESCRIPTION OF DRAWINGS

Other features of this invention will appear in the following description and appended claims, reference being made to the accompanying drawings forming a part of the specification wherein like reference characters designate corresponding parts in the several views.

DESCRIPTION OF THE SPECIFIC EMBODIMENTS

Figure 1:
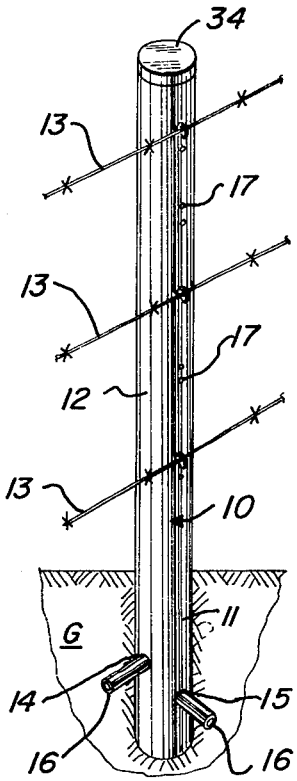
FIG. 1 is a perspective view of the fence post according to the present invention showing the ground removed to reveal the post anchor tubes.
Figure 2:
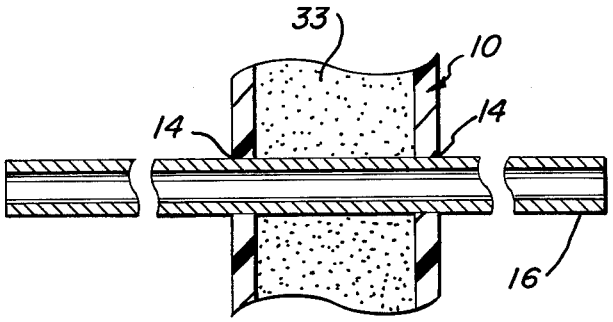
FIG. 2 is a partial sectional view showing the foam filled post with the anchor tube passing therethrough and extending beyond the edges of the post to secure it in the ground and prevent twisting or rotation.
Figure 3:
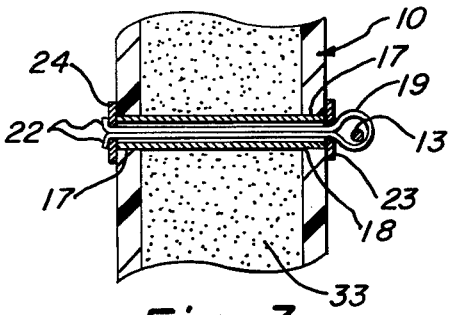
FIG. 3 is a partial sectional view showing the foam filled post with an insert tube transversely installed through holes in the post, a wire clip with washers is shown inserted through the holes to secure the fence wire.
Figure 6:
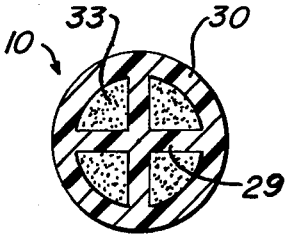
FIG. 6 is a sectional view of the fence post according to the present invention showing internal ribs or flanges provided for strength.

As illustrated in FIG. 1, the fence post 10 according to the present invention includes a lower portion 11 which is intended to be buried in the ground and an upper exposed portion 12 to which the fence wire strands 13 are attached. It is unimportant as to what type of wire is to be utilized with the fence post of the present invention and for the sake of illustration barbed wire is shown in FIG. 1. It is therefore understood that any type of wire such as strands or woven mesh may be utilized with the post of the present invention.

In the buried portion 11 of the post 10 transverse, aligned holes 14, 15 are provided with hollow tubes or solid rods 16 are inserted therein. These tubes 16 are sized to have sufficient length whereby the ends extend a considerable distance beyond the outer surface of the post 10. The tubes 16 may be secured to the post by means of an adhesive or can be allowed to remain free so they can be slidably inserted into the holes at the time of installation. One of the advantages of permitting the tubes 16 to be slidably inserted is that the post can be more easily packed and shipped with the tubes 16 shipped in a separate container. If desired, the tubes 16 can be cemented in place at the site prior to installation. In either case, once the post 10 is buried the tube 16 and post 10 will be held in relative position with no movement possible. The purpose of the anchoring tubes 16 which can be provided in any numer and arranged perpendicular to each other and spaced vertically is to prevent the post from rotating during use and also to aid it in remaining firm and solid in the ground.

The upper portion 12 of the post 10 has a plurality of pairs of vertically aligned and spaced holes 17 arranged to extend through the post 10. These holes 17 are spaced according to any pattern desired to accommodate a number of wire strands. An insert tube 18 is provided in each pair of the holes 17 and cut off flush with the outside surface of the post 10. These tubes are secured in position by suitable adhesive to prevent their removal and also to prevent moisture from entering into the interior of the post.

A hairpin type clip 19 having legs 20, eye 21 and curved hooks 22, fabricated from a spring material, are provided to secure the wire 13 to the post 10. The clip 19 is arranged to pass over the wire 13 and with the legs held together passed through the washers 23, 24 on each side of the post with the hooks 22 allowed to expand at the outside of the washer 24 to secure the clip in place. In this way it is a simple operation to secure the fence wire 13 to the post 10 by means of the clip 19. The clip also can be easily removed by reversing the above operation.

Figure 5:
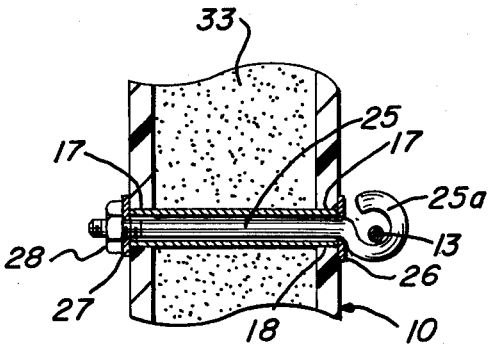
FIG. 5 is a partial sectional view showing another embodiment for securing the wire fence by the use of an eye-bolt.

FIG. 5 shows another device for securing the wire strand 13 to the post 10. In this embodiment an eye-bolt 25 is passed through washers 26 and 27 on each side of the post and is threadedly secured by nut 28. The fence wire 13 is inserted through the open eye of the bolt 25 and is therefore supported in position adjacent to the post.

Figure 7:
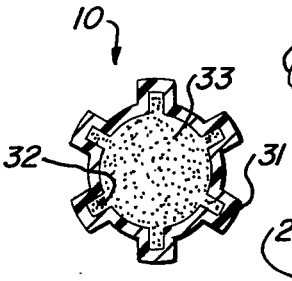
FIG. 7 is a sectional view of the fence post according to the present invention showing grooves and ridges in the sidewall of the post to provide additional strength.
Figure 4:
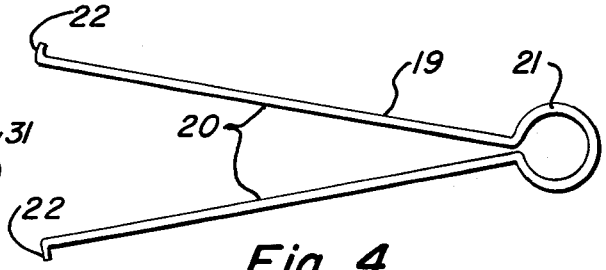
FIG. 4 is a plan view of the wire clip shown in FIG. 3.
Figure 8:
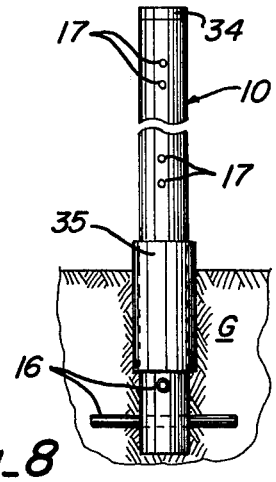
FIG. 8 is a side elevation view of the fence post according to the present invention installed and provided with an additional reinforcing sleeve at ground level.

In order to reinforce the post 10, solid reinforcing flanges 29 integrally formed with the tube 30 forming the post 10 can be provided to add additional rigidity and strength. If desired, a cross-sectional arrangement such as that shown in FIG. 7 can be provided in which longitudinal ridges 31 and grooves 32 are provided along the sidewall of the post 10 to provide strength. It is to be understood that any number of strengthening designs can be provided in the molding or fabrication of the post 10 to provide the strengthening or reinforcing desired.

The hollow or core portion of the post 10 can be filled with a rigid or semi-rigid material 33 to also provide additional strength. This reinforcing can be a foam plastic or any kind of an aggregate or loose material which can be solidified by mixing with any type of cement or adhesive material. The post itself can be manufactured by molding, extruding or forming with any water impervious plastic material such as ABS or fiber reinforced synthetic resins such as fiber glass. The insert tubes can be manufactured from the same material as the post.

To seal the post from the weather, a cap or cover 34 can be joined to the upper end of the post 10 by a suitable adhesive. At the same time, to improve and reinforce the post 10 at ground level where the post is subject to the most severe stresses, a reinforcing sleeve 35 can be bonded to the outside of the post 10 to provide additional strength. This sleeve can, also, be sized to be inserted within the interior of the post 10 prior to the foam filling 33 of the core.

While an improved plastic fence post has been shown and described in detail it is obvious that this invention is not to be considered as limited to the exact form disclosed and that changes in detail and construction may be made therein within the scope of the invention without departing from the spirit thereof.

Having thus set forth and disclosed the nature of this invention, what is claimed is:

1. An improved fence post for supporting strands of fence wire comprising:

a. a hollow, tubular body of a uniform internal and external diameter having a sidewall fabricated from a dielectric, high strength plastic material which is impervious to weather and soil conditions, said body having a lower buried anchoring portion and an upper exposed portion, b. said lower buried portion having one or more, relatively short, transverse anchoring tubes inserted through aligned holes in said body and arranged to extend a short distance beyond the sides of said body whereby when the post is buried in the ground said tubes will prevent the rotation of the post and secure it firmly in the ground;

c. the exposed portion of said body has a plurality of vertically spaced holes on opposite sides of said tubular body being generally pairs of aligned holes passing through said body, each of said pairs of holes having an insert tube affixed therein and sealed to the sidewall of said body, at least one of said insert tubes having fence wire securing means arranged therethrough to support said fence wire above the ground; and d. said body being filled with a lightweight, substantially rigid material whereby said body is reinforced and strengthened.

2. A fence post as defined in claim 1 wherein said fence wire securing means is an elongated U-shaped clip formed from spring steel material and including a pair of legs interconnected by an eye at one end and hooks provided at the opposite end of each of said legs whereby the wire strand can be inserted into the eye with the legs inserted through the insert tube of said body and the hook portion of the legs engage the opposite side of the body to secure the wire in place.

3. A fence post as defined in claim 1 wherein: said post is provided with a hollow sleeve arranged around the outside of said body to cover the junction area between the buried and exposed portion of said body to thereby reinforce the post in the area of the ground surface.

* * * * *